US006866484B2

(12) United States Patent
Reitzig

(10) Patent No.: US 6,866,484 B2
(45) Date of Patent: Mar. 15, 2005

(54) MULTI-CYLINDER HIGH-PRESSURE PLUNGER PUMP

(76) Inventor: Klaus Reitzig, Werkstr. 7, 47661 Issum (DE)

( * ) Notice: Subject to any disclaimer, the term of this patent is extended or adjusted under 35 U.S.C. 154(b) by 0 days.

(21) Appl. No.: 10/179,338

(22) Filed: Jun. 25, 2002

(65) Prior Publication Data

US 2003/0002990 A1 Jan. 2, 2003

(30) Foreign Application Priority Data

Jun. 27, 2001 (DE) ..... 101 31 001

(51) Int. Cl.[7] ..... F04B 1/26; F04B 13/04
(52) U.S. Cl. ..... 417/222.1; 92/122
(58) Field of Search ..... 92/12.2; 417/222.1, 417/212, 218, 269

(56) References Cited

U.S. PATENT DOCUMENTS 2,256,079 A * 9/1941 Dinzl ..... 103/162
2,940,325 A * 6/1960 Nakesch ..... 74/60
3,304,886 A 2/1967 Roberts
3,873,240 A 3/1975 Leduc et al.
4,364,230 A * 12/1982 Holmes ..... 60/444
4,418,586 A * 12/1983 Maki et al. ..... 74/831
4,513,630 A * 4/1985 Pere et al. ..... 74/60
5,113,809 A * 5/1992 Ellenburg ..... 123/58 BA
5,498,140 A * 3/1996 Kawaguchi et al. ..... 417/199.1
5,782,161 A 7/1998 Okubo et al.

* cited by examiner

*Primary Examiner*—Charles G. Freay
(74) *Attorney, Agent, or Firm*—Patterson, Thuente, Skaar & Christensen P.A.

(57) ABSTRACT

The invention relates to a multi-cylinder high-pressure plunger pump with a plurality of plungers and a drive unit therefor which is arranged in a housing, the plungers being arranged equidistantly on a circle and the drive unit comprising a roller which is mounted rotatably in the housing and carries along a wobble plate with wobbling action about the axis of rotation of the roller, axially moveable plunger actuators each coupled to a plunger being pressed against the wobble plate.

16 Claims, 6 Drawing Sheets

Fig. 5
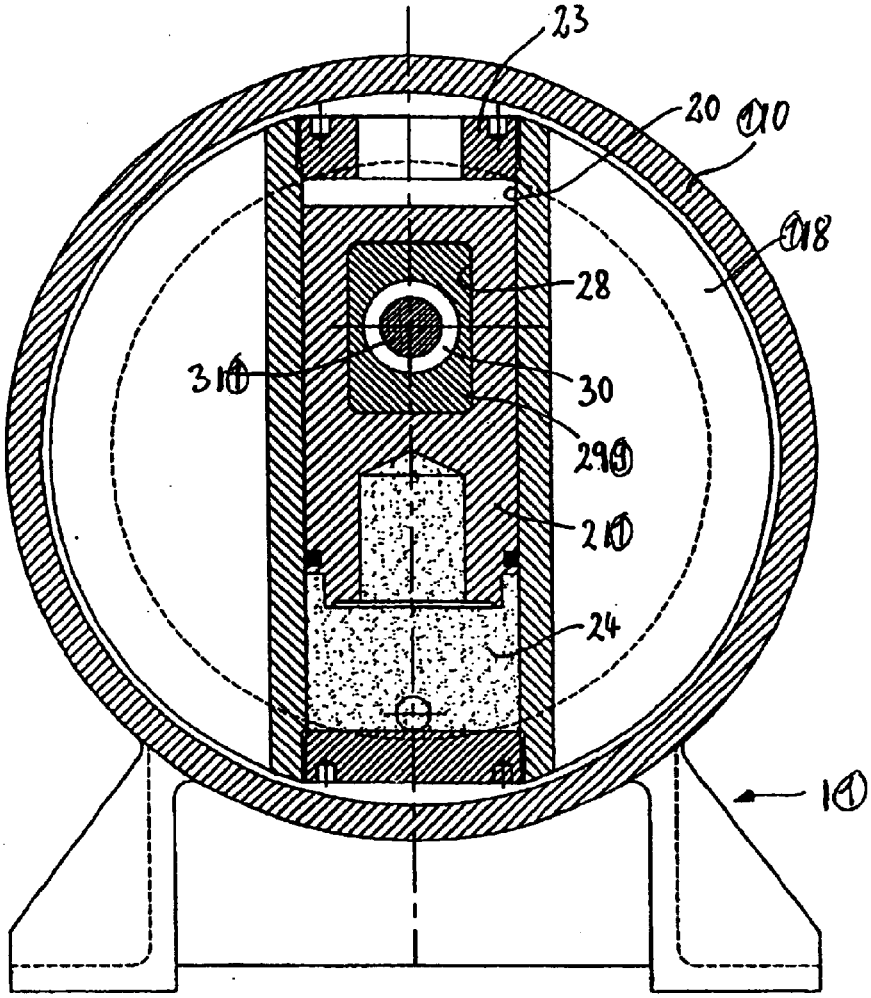
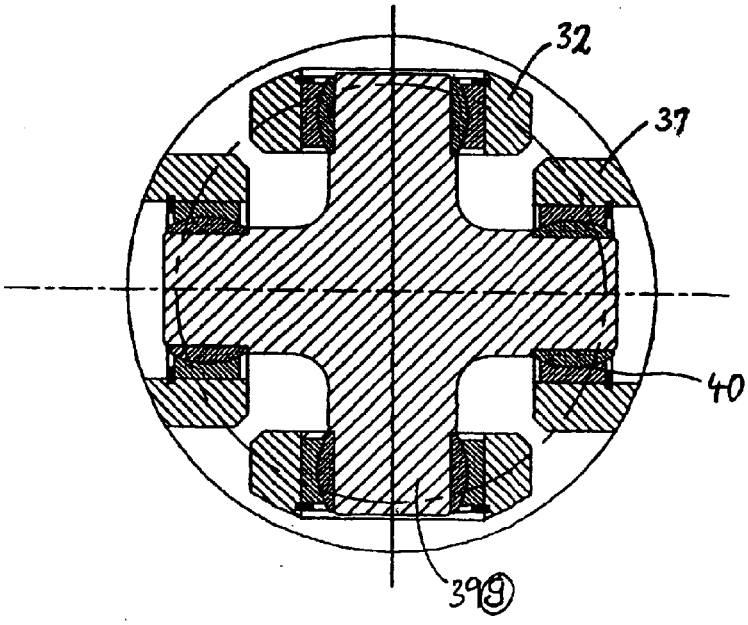
Fig. 6

MULTI-CYLINDER HIGH-PRESSURE PLUNGER PUMP

FIELD OF THE INVENTION

The invention relates to a multi-cylinder high-pressure plunger pump as it is used for producing high-pressure water jets which are used for different purposes as for cutting material like metal sheets or cleaning surfaces.

BACKGROUND OF THE INVENTION

German Published Patent Application DE 196 53 158 A1 discloses an axial plunger pump, there being provided a wobble plate which serves for moving the plungers via axially moveable plunger actuators each coupled to a plunger. The wobble plate here is mounted via a cam plate in relation to the housing and is at a fixed angle to the axis of rotation.

Accordingly, volume control of the pumped fluid is neither envisaged nor feasible.

Japanese Published Patent Application JP 61-277881 A, furthermore, discloses a multi-cylinder high-pressure plunger pump in the case of which a multi-cylinder pump head with a row of cylinders is provided, the pump head being flanged onto a crank housing which accommodates a crankshaft and cranks which are driven by the latter and drive corresponding plungers such that they can be moved back and forth.

Apart from the fact that it is only possible here to adjust the pressure via the rotational speed of the crankshaft in relatively small ranges, the drive requires expensive components such as the crankshaft and the like.

SUMMARY OF THE INVENTION

It is an object of the invention is to provide a multi-cylinder high-pressure plunger pump provided with a volume control. It is a further object of the invention to provide a multi-cylinder high-pressure plunger pump with a linear pressure control via the rotational drive speed of the pump. It is an additional object of the invention to provide a multi-cylinder high-pressure plunger pump of a simple construction and with a volume control.

The invention proposes a multi-cylinder high-pressure plunger pump comprising:

a plurality of plungers arranged equidistantly on a circle;

a drive unit for said plungers, said drive unit being arranged in a housing and comprising a drive part which is mounted rotatably in the housing and carries along a wobble plate with wobbling action about the axis of rotation of the drive part; and axially moveable plunger actuators each coupled to a plunger being pressed against the wobble plate, wherein the drive part is a roller which has a cutout which extends in the direction of the axis of rotation of the roller and accommodates a mount in the manner of a ball-and-socket joint and rotating along with the roller; and wherein said cutout is arranged in a hydraulically activatable piston which is mounted in a roller bore such that it is displaceable perpendicularly to the direction of rotation of the roller.

Since the plungers are arranged equidistantly on a circle and the drive unit comprises a roller about the axis of rotation of which a wobble plate is arranged with wobbling action, axially moveable plunger actuators each coupled to a plunger being pressed against said wobble plate, it is not just possible essentially to use, as the components, castings which do not require much machining, and to avoid expensive forgings; rather, apart from the fact that the pressure can be adjusted via the rotational drive speed of the pump, provision is also made for a linear volume control for example from zero up to a maximum.

Further objects, embodiments and advantages of the invention will become apparent from the following description and the claims.

BRIEF DESCRIPTION OF THE DRAWINGS

The invention will be explained in more detail hereinbelow with reference to a preferred embodiment illustrated in the attached drawings.

FIG. 1 shows a side view of a multi-cylinder high-pressure plunger pump.

FIG. 5 shows a section along line V—V from FIG. 4.

FIG. 6 shows, in section, an embodiment of a spherical articulation for the high-pressure plunger pump from FIG. 1.

DETAILED DESCRIPTION OF THE PREFERRED EMBODIMENT

Figure 2:
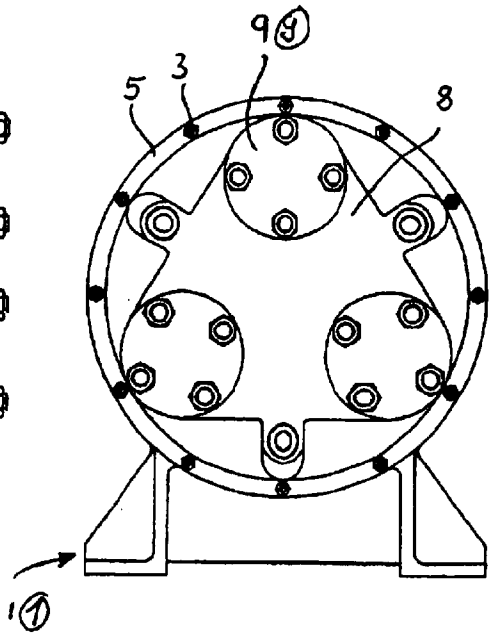
FIG. 2 shows an end view of the high-pressure plunger pump from FIG. 1.
Figure 10:
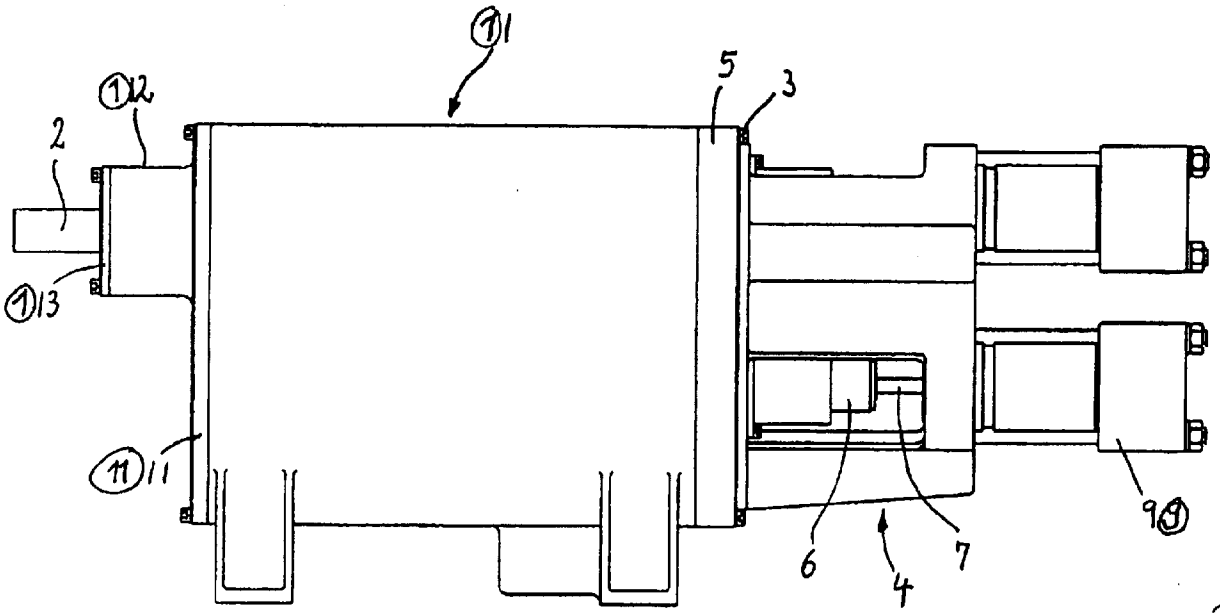

The high-pressure plunger pump illustrated comprises a housing 1 for accommodating a drive unit with an input shaft 2, which can be coupled to a drive subassembly, such as an electric motor, on one end side of the housing 1. Fastened on the housing 1 via screws 3 is a carrier 4, the so-called cage, which has a panel 5 which closes the housing 1 on the end side located opposite the input shaft 2. The panel 5 bears plunger actuators 6, which are coupled to plungers 7. The carrier 4 comprises a panel 8 which is spaced apart from the panel 5, parallel thereto, and bears a plurality of, in the exemplary embodiment illustrated three, pump heads 9, of which the longitudinal axes are arranged, corresponding to the longitudinal axes of the plungers 7, equidistantly on a circle.

It is possible here for the plungers 7, as has been described for example in the German Patent DE 198 19 972 C1 which is incorporated by reference hereby, to be guided in pressure sleeves, a suction valve and a pressure valve with corresponding valve elements arranged one behind the other being provided in each case coaxially in relation to the pressure-sleeve axis and connecting a working space of the respective plunger 7 to an intake chamber and the working space to a pressure chamber of a common pressure space. It is possible here for the valve elements to comprise an insert body with a continuous bore which, on the one hand, is open to the working space of the associated plunger 7 and, on the other hand, is closed by the pressure valve during the suction stroke of the associated plunger, said bore accommodating a pressure sleeve which, on the pressure-chamber side, is screwed to a pressure-valve guide sleeve which accommodates the pressure-valve elements, is supported against the insert body and clamps the pressure sleeve, on the plunger side, with sealing action against the insert body.

Figure 3:
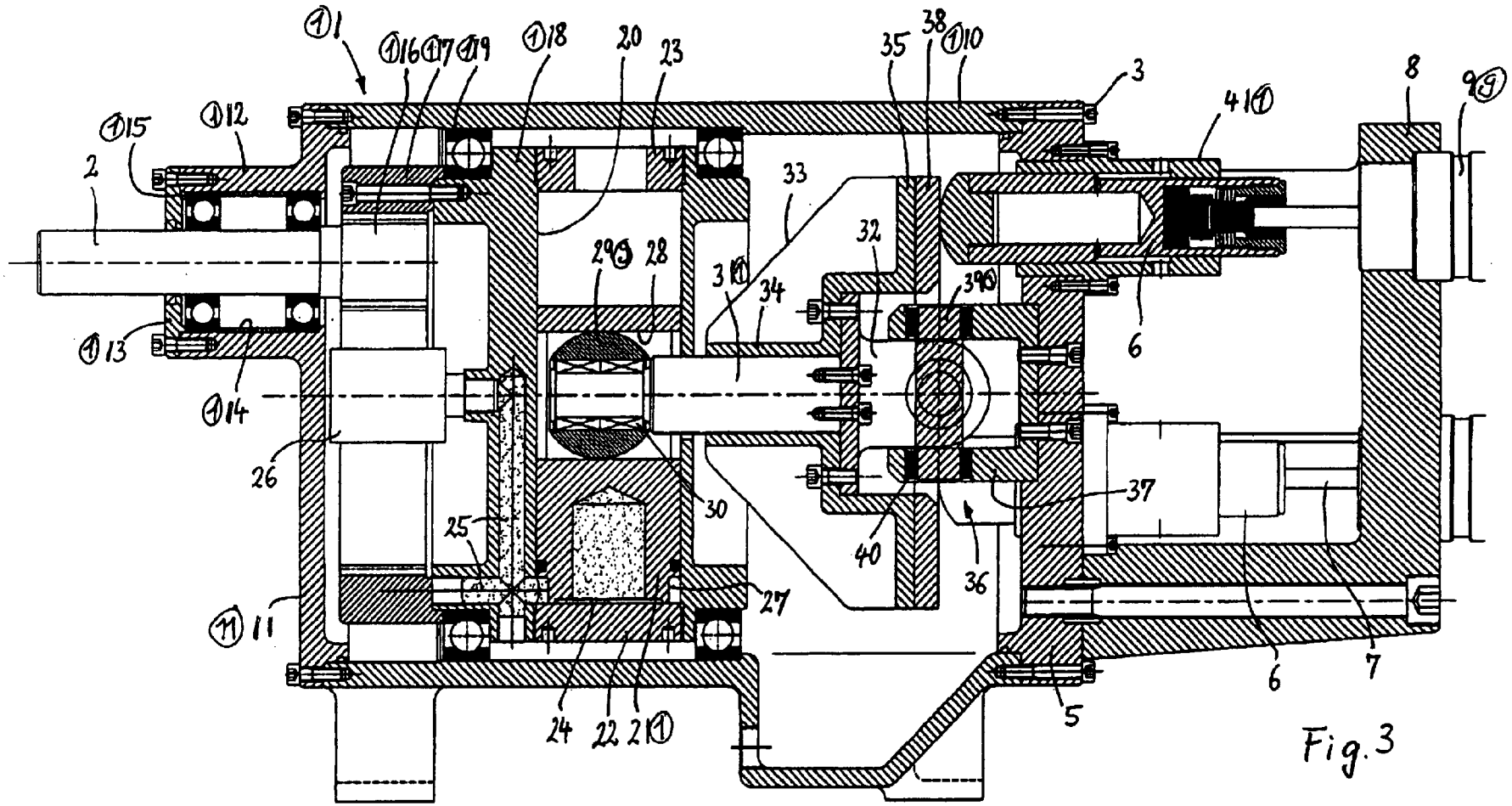
FIGS. 3 and 4 show, in detail form and in axial section, the high-pressure plunger pump from FIG. 1 in differently adjusted stroke positions.
Figure 4:
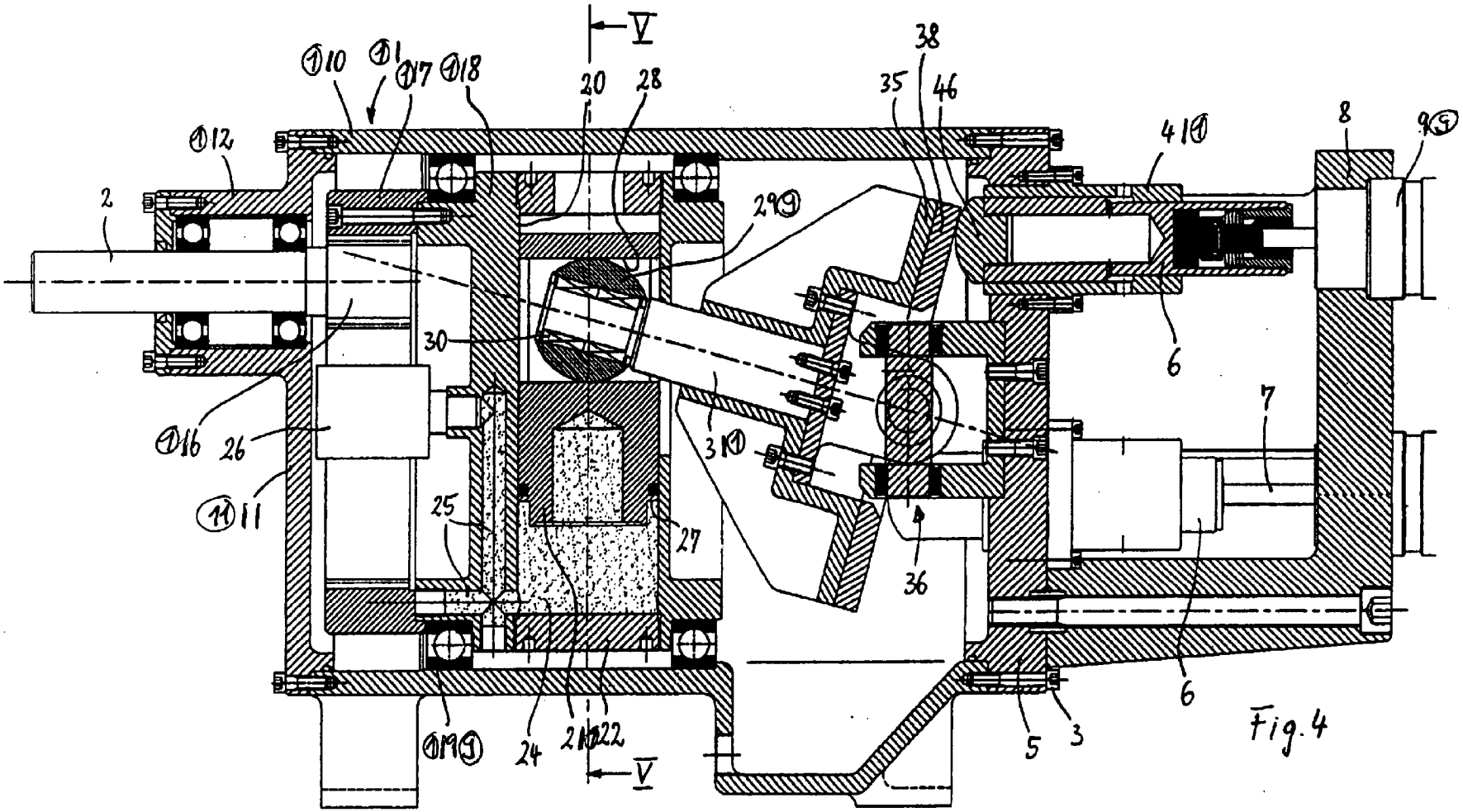

As can be seen from FIGS. 3 and 4, the housing 1 comprises an essentially cylindrical section 10, preferably in the form of a casting, which is closed on one end side by a cover 11, which bears a stub 12 which is closed by a panel 13 and accommodates two rolling-contact bearings 15 which are spaced apart by a ring 14 and are intended for bearing the input shaft 2.

The input shaft 2 bears, at the end, a pinion 16, which meshes with an internally toothed hollow wheel 17. The hollow wheel 17 is arranged coaxially in relation to a roller 18 and is screwed to the latter. The roller 18 is mounted rotatably in the cylindrical section 10 of the housing 1 via rolling-contact bearings 19. The roller 18 may likewise be a casting which only requires a small amount of machining.

The roller 18 has a roller bore 20 which runs transversely to the axis of the input shaft 2, and thus transversely to the axis of rotation of the roller 18, accommodates a piston 21 and, on the one hand, is closed by a panel 22 and, on the other hand, is bounded by a stop ring 23. Located between the piston 21 and the panel 22 is a chamber 24 which is connected, via corresponding bores 25, to a hydraulic rotary lead-through 26 via which pressure medium can be fed to the chamber 24, as is indicated by dots in FIGS. 3 and 4. The piston 21 has an encircling step 27 which, before the piston 21 is lifted off from the panel 22, is pressure-activated in order to cause said piston to be lifted off.

As can be seen from FIG. 5, which shows a section along the longitudinal axis of the roller bore 20, the piston 21 has a cutout 28, which is essentially rectangular in plan view and accommodates an insert 29. The insert 29 is of spherical design in the axial direction of the cutout 28 and is seated via bearings 30, for example needle bearings, at one end, the tapered end, of a pin 31. The latter is routed out of the roller 18 through a corresponding opening and screwed to an articulation fork 32, which is inserted into a cup-like depression of a wobble plate 35, reinforced on the rear side by ribs 33 and provided with a sleeve 34 for accommodating the pin 31, and is screwed to the wobble plate 35, see FIGS. 3 and 4. The articulation fork 32 is part of a spherical articulation 36 which encloses a housing-mounted articulation fork 37 and about which the wobble plate 35 can be pivoted by being displaced from the central position, which is illustrated in FIG. 3, into a pivoted angle position, which is illustrated in FIG. 4.

If it is only intended to install a predetermined level of power which cannot be changed, there is no need to provide a displaceable piston 21. The cutout 28 may be provided directly in the roller 18.

The wobble plate 35 bears a hardened, and thus wear-resistant, pressure plate 38, the plunger actuator 6 being kept pressed against the same. The plunger actuators 6 can be moved axially in relation to the longitudinal axis of the plunger 7 as a result of the wobbling movement of the wobble plate 35.

By virtue of the pressure space 24 being correspondingly subjected to the action of pressure, the piston 21 is adjusted in the roller bore 20, as a result of which the angle of the wobble plate 35, articulated at the articulation 36, in relation to the longitudinal axes of the plunger actuator 6, and thus in relation to the longitudinal axes of the plungers 7, is adjusted correspondingly. Since the plunger actuators 6 are kept pressed against the pressure plate 38, this maintains a predetermined angle corresponding to a predetermined pressure, by means of which the pump stroke is determined. At 0°, the pump stroke is zero. If the hydraulic pressure is reset to zero, the pressure to which the wobble plate 35 is subjected by the plunger actuators 6 results in said wobble plate being guided back into its starting position from FIG. 3.

However, it is also possible for the pump to be designed such that the piston 21 is activated by pressure fluid on both sides, rather than on just one side, in order for its position within the roller bore 20, and thus for the pump stroke, to be adjusted.

As a result of the roller 18 being rotated by being driven by means of the input shaft 2, the wobble plate 35 wobbles without rotating in relation to the roller 18. This results in a corresponding stroke of the plunger actuators 6 and thus of the plungers 7.

As can be seen from FIG. 6, the articulation 36 of the embodiment illustrated there comprises a cross pin 39, of which the ends are mounted, via spherical sliding articulation bearings 40 in each case, in the two mutually opposite legs of the housing-mounted articulation fork 37 and, offset through 90° in relation to this, in the wobble-plate-side articulation fork 32. This means that allowances can easily be made for production tolerances. Instead of the above, it is also possible to use any other type of cardanic joint.

Figure 7:
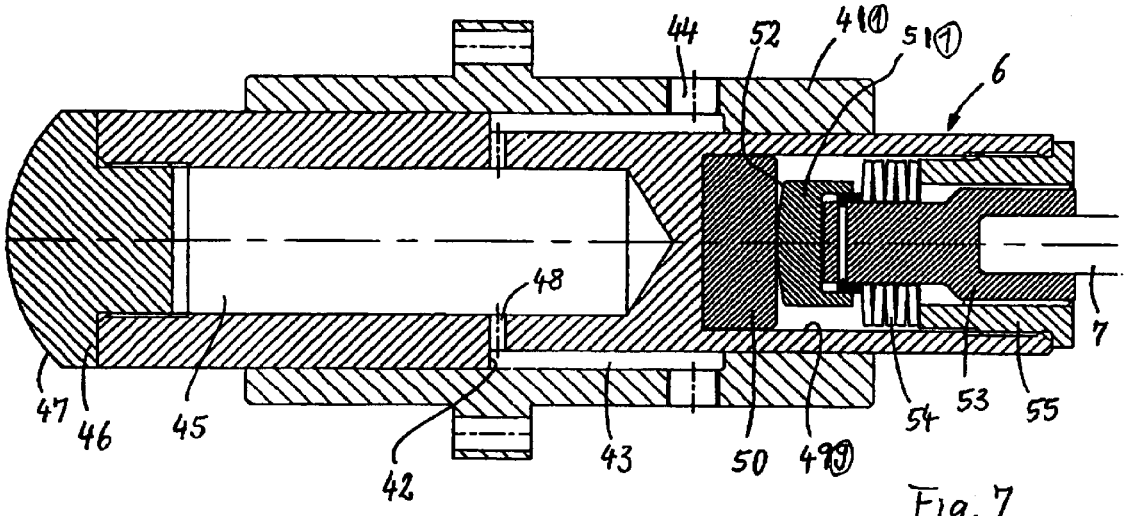
FIG. 7 shows an embodiment of a plunger actuator for the high-pressure plunger pump from FIG. 1.

As can be seen from FIG. 7, a guide bushing 41 is provided for each plunger actuator 6, the guide bushing being inserted into a corresponding opening of the panel 5 and being screwed to the latter. The plunger actuator 6, as a differential piston, is provided with a shoulder 42, as a result of which an annular space 43 is formed in the guide bushing 41, it being possible for said annular space to be subjected to the action of compressed air of, for example, 2 bar from the outside, via an opening 44, in order for the plunger actuator 6 to be kept pressed in abutment against the pressure plate 38. The plunger actuator 6 has an inner bore 45 which, adjacent to the pressure plate 38, is closed by an end piece 46, which forms a stopper and has a spherical surface 47 butting against the pressure plate 38. A bore 48 of small diameter leads from the annular space 43 into the space formed by the inner bore 44, in order for the latter space to act as a compensating reservoir, with the result that excessive heating of the compressed air is prevented. The compressed-air lines leading to the individual guide bushings 41 are connected to one another.

Instead of the plunger actuators 6 being activated by compressed air, it is also possible to provide a spring, although a greater overall length is required for this, so the embodiment from FIG. 7 is preferred.

The plunger actuator 6, on the plunger side, has a blind bore 49, which accommodates a pressure plate 50 on the base. A bearing shoe 51 with a spherical bearing surface 52 rolls on said pressure plate, and is arranged at the adjacent end of a plunger shoe 53, this end being pressed against the pressure plate 50 by the bearing shoe 51, via cup springs 54. In this case, the assembly of cup springs 54 is subjected to stressing by means of a clamping sleeve 55, which is inserted into the blind bore 49 and encloses the plunger shoe 53 at a distance from the latter. The plunger 7 is thus correspondingly coupled in an articulated manner.

Figure 8:
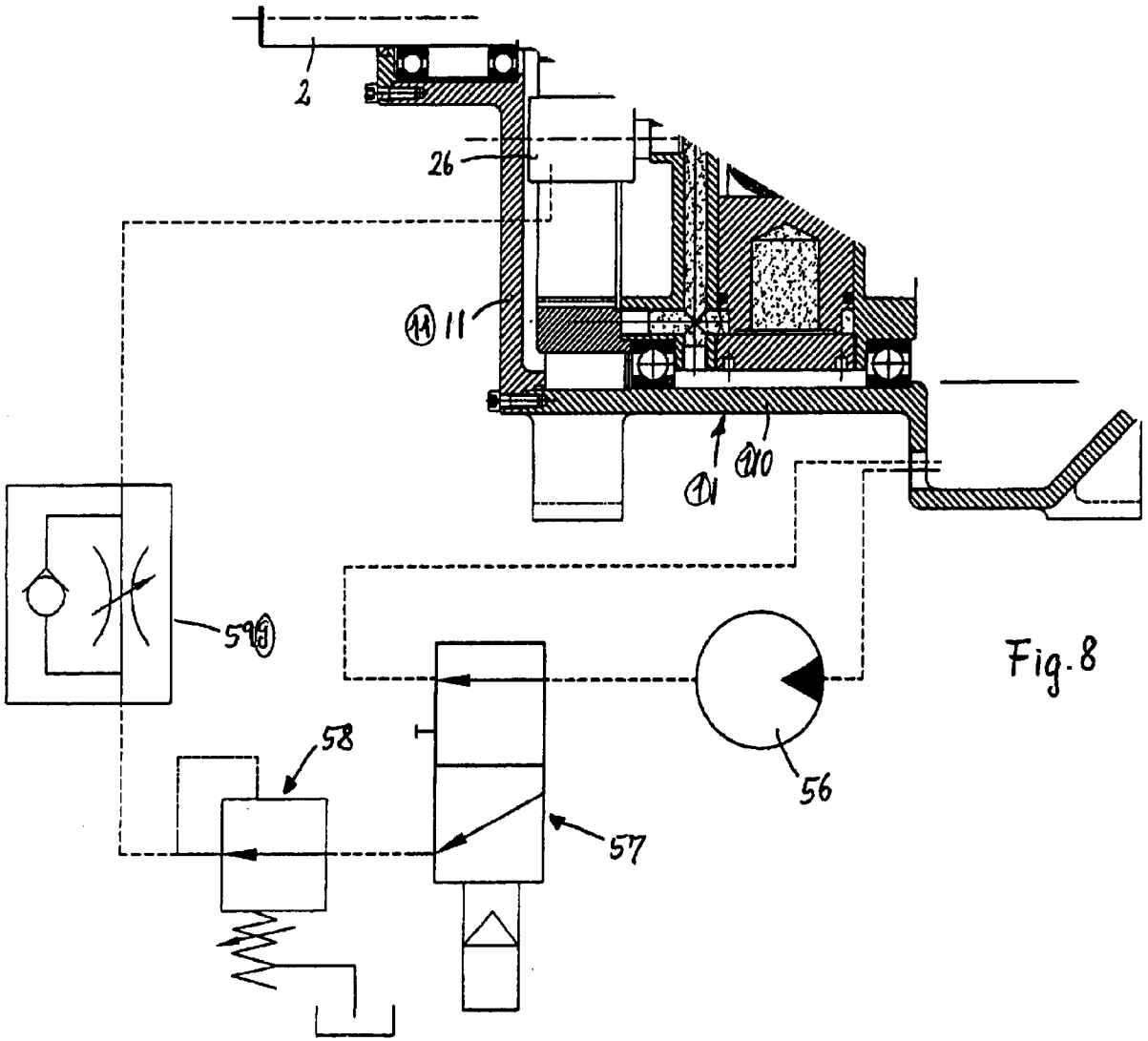
FIG. 8 shows an embodiment of a hydraulic circuit for the high-pressure plunger pump from FIG. 1.

As can be gathered from FIG. 8, the high-pressure plunger pump has a hydraulic circuit which comprises an oil pump 56 which, with the interior of the housing 1, forms a circuit which also comprises a 3/2-way or 5/3-way valve 57, the latter having arranged downstream of it a pressure-regulating valve 58 via which the pressure in the chamber 24, and thus the stroke of the high-pressure plunger pump, can be adjusted. In addition, a throttle nonreturn valve 59 is arranged between the pressure-regulating valve 58 and the hydraulic lead-through 26.

While the invention has been shown and described with reference to a preferred embodiment, it should be apparent to one of ordinary skill in the art that many changes and modifications may be made without departing from the spirit and scope of the invention as defined in the claims.

What is claimed is:

1. A multi-cylinder high-pressure plunger pump comprising:

a plurality of plungers arranged equidistantly on a circle;

a drive unit for said plungers, the drive unit being arranged in a housing and comprising a drive part which is rotatably mounted about an axis of rotation in the housing and carries along a wobble plate with wobbling action about the axis of rotation of the drive part, the wobble plate being tiltable via a joint arranged in the housing; and axially moveable plunger actuators each coupled to a plunger, the plunger actuators being pressed against the wobble plate;

wherein the drive part is a roller being provided with a first opening extending in a direction perpendicular to the axis of rotation, the first opening taking up a piston such that it is displaceable perpendicularly to the axis of rotation, the piston being displaceable by a hydraulic load, the piston being provided with a cut-out extending in the direction of the axis of rotation accommodating a mount in the form of a ball-and-socket joint connected with the wobble plate through a second opening in the roller and rotating together with the roller, the ball portion of the mount being axially displaceable within the cut-out as the piston is displaced during operation of the pump.

2. The high-pressure plunger pump of claim 1, wherein the wobble plate, which is articulated cardanically on the housing on one side, is mounted on the other side in the roller in the manner of a ball-and-socket joint in relation to the axis of rotation of the roller.

3. The high-pressure plunger pump of claim 1, wherein the piston can be activated hydraulically on one or both sides.

4. The high-pressure plunger pump of claim 1, wherein the roller is coupled in a rotationally fixed manner to a hollow wheel, which can be driven by an input shaft.

5. The high-pressure plunger pump of claim 2, wherein the housing-mounted articulation of the wobble plate comprises two crossover articulation forks with a cross pin, which is mounted in the articulation forks via sliding articulation bearings.

6. The high-pressure plunger pump of claim 1, wherein the wobble plate bears a pressure plate, which is in engagement with the plunger actuators.

7. The high-pressure plunger pump of claim 1, wherein the wobble plate has a pin which is mounted in the cutout via an insert mounted on the pin.

8. The high-pressure plunger pump of claim 1, wherein the housing has a cylindrical section, in which the roller is mounted.

9. The high-pressure plunger pump of claim 1, wherein the housing has a cover, which bears an input shaft.

10. The high-pressure plunger pump of claim 1, wherein the housing is closed on the wobble-plate side by a panel, which bears the housing-mounted articulation of the wobble plate and has through-passage openings for the plunger actuators.

11. The high-pressure plunger pump of claim 1, wherein the plunger actuators are designed as differential pressure pistons which are accommodated by guide bushings and can be activated by pressure medium.

12. The high-pressure plunger pump of claim 11, wherein the plunger actuators are activatable by compressed air and are hollow, their interior being connected to an outer annular space, which can be subjected to the action of compressed air, via a narrow bore.

13. The high-pressure plunger pump of claim 1, wherein plunger actuators have end pieces which have a spherical surface and are retained by the wobble plate.

14. The high-pressure plunger pump of claim 1, wherein the plungers are articulated in the manner of a ball-and-socket joint on the plunger actuators.

15. The high-pressure plunger pump of claim 2, wherein the piston can be activated hydraulically on one or both sides.

16. A multi-cylinder high-pressure plunger pump comprising: a plurality of plungers arranged equidistantly on a circle:

a drive unit for said plungers, said drive unit being arranged in a housing and comprising a drive part rotatably mounted in the housing and a wobble plate having a wobbling action about an axis of rotation of the drive part; and a plurality of axially moveable plunger actuators, each actuator being individually coupled to one of the plungers with the actuators being pressed against the wobble plate, wherein the drive part is a roller which has a cutout extending in the direction of the axis of rotation of the drive part, the cutout accommodating a mount in the manner of a ball-and-socket joint and rotating along with the roller, the cutout being further arranged to accommodate a hydraulically positionable piston adapted to vary the wobbling action of the wobble plate.

* * * * *